US007389555B2

(12) United States Patent
Xu

(10) Patent No.: US 7,389,555 B2
(45) Date of Patent: Jun. 24, 2008

(54) LARGE RESISTING DISTORTION COMB-TYPE BRIDGE EXPANSION JOINT

(76) Inventor: Bin Xu, Ningbo Free Trade Zone Lubao Traffic Equipment Co., 205 West Huangshan Road, Beilum Zone, Ningbo City, Zhejiang Province (CN) 315800

( * ) Notice: Subject to any disclaimer, the term of this patent is extended or adjusted under 35 U.S.C. 154(b) by 72 days.

(21) Appl. No.: 10/596,667

(22) PCT Filed: Aug. 16, 2004

(86) PCT No.: PCT/CN2004/000951

§ 371 (c)(1),
(2), (4) Date: Jun. 20, 2006

(87) PCT Pub. No.: WO2005/071164

PCT Pub. Date: Aug. 4, 2005

(65) Prior Publication Data

US 2007/0044257 A1 Mar. 1, 2007

(30) Foreign Application Priority Data

Jan. 8, 2004 (CN) ..... 2004 1 0015739
Jun. 16, 2004 (CN) ..... 2004 1 0049491

(51) Int. Cl.
*E01D 19/06* (2006.01)

(52) U.S. Cl. ..... 14/73.1; 14/73.5; 52/396.04

(58) Field of Classification Search ..... 52/393, 52/395, 396.04; 14/73.1, 73.5; 404/47, 56
See application file for complete search history.

(56) References Cited

U.S. PATENT DOCUMENTS 2,976,782 A * 3/1961 Thom ..... 404/47
3,750,359 A * 8/1973 Balzer et al. ..... 52/468
6,022,169 A * 2/2000 Kim et al. ..... 404/52
6,460,214 B1 10/2002 Chang

* cited by examiner

*Primary Examiner*—Gary Hartmann
(74) *Attorney, Agent, or Firm*—Global IP Services; Tianhua Gu

(57) ABSTRACT

A large resisting distortion combo-type bridge expansion device, comprises fixed comb plate 2 and moveable comb plate 1 which are respectively disposed on the girder 10 where at the two sides of the bridge expansion device, the moveable comb plate 1 has comb teeth 11 interdigitate with the comb teeth 21 of the fixed comb plate, the moved comb plate 1 has a rotating shaft 8 at the bottom of its second end, and the two ends of the rotating shaft 8 pivot in the shaft seat 7 which is directly or indirectly fixed on the girders 10. In the present invention the second end of the moveable comb plate is rotatable, by which the moved comb plate will rotate round the girders when the girders have deflection distortion and the ends of the girders are raising or sinking. Therefore, the moved comb plate can keep flat to avoid damage of the expansion device, and to ensure that the vehicle can pass safely and smoothly.

12 Claims, 6 Drawing Sheets

LARGE RESISTING DISTORTION COMB-TYPE BRIDGE EXPANSION JOINT

FIELD OF THE INVENTION

The present invention relates to bridge expansion joints, in particular, to a large resisting distortion comb-type bridge expansion joint whose expansion amount can reach above 300 mm.

DESCRIPTION OF THE PRIOR ART

Among recent bridge expansion joints, a relatively good technique is the comb-type expansion joint, which comprises a fixed comb plate and a movable comb plate cooperating each other, and it is especially applied in the large bridge expansion joint whose expansion amount is more than 160 mm. For example, the Chinese patent No. ZL02264872.0 titled "Assemble Type Comb-type Bridge Expansion joint" invented by Bin Xu disclosed that the bridge expanding movement is provided by the movable comb plate, no lengthways transition space is existed between the fixed comb plate and the movable comb plate, and the joint connects the bridge surface and road surface as a whole, thereby, the ability of resisting vibration is very good, the vehicle can drive smoothly and comfortably on the bridge without jumping.

However, to these very large bridges whose expansion amount is more than 300 mm, under the effect of vehicle loads or temperature the girder will have shift to raise the end of girder, together with the comb teeth on the steel comb plate and the comb plate itself, and cause the whole joint damage finally. This disadvantage is overcome by another Chinese patent No. ZL02265765.7 titled "A Very Large Shift Amount Comb-type Bridge Expansion Joint" invented by Bin Xue. This patent disclosed an expansion joint; its movable comb plate is a rotatable device, which comprise a movable plate, a movable connecting plate and a comb teeth which are arranged in order. When the girders have some shifts and the end of the girders rise under the effect of vehicle loads, the movable plate of the movable comb plate will rise accordingly. Then, the movable connecting plate and movable plate will rotate relatively, to make the movable connecting plate and its comb teeth still stay on the girders.

But, among the super large bridges whose expansion amount is more than 500 mm, the shift of the girders under the effect of vehicle loads is especially serious, the rising of the movable plate is serious too, even causes the rising of the movable connecting plate and its comb teeth separating from the girders. When the vehicle passes under this condition, the whole expansion joint will be damaged immediately.

Besides, to the recent popular super large stayed-cable bridges, when the bridge is under the effect of loads and other internal or external forces, the end of the girder will have multi-direction shift such as shift vertically, transversely, slantways or rotate. Under this situation, all kinds of prior existing expansion joint cannot perform effectively at all.

SUMMARY OF THE INVENTION

It is an object of the present invention to provide a large resisting distortion comb-type bridge expansion joint which keeps lying flatly when its girders have multi-direction shift such as distort vertically, transversely, slantways or rotate under the effect of load or other forces.

For achieving the objects, the expansion joint of the present invention comprises a fixed comb plate and a movable comb plate which are respectively disposed on the girders located at the two sides of the bridge expansion joints, the movable comb plate has a plurality of comb teeth at its first end, and the comb teeth interdigitate with the comb teeth of the fixed comb plate, characterized in that the said movable comb plate has a rotating shaft at the bottom of its second end, and the two ends of the said rotating shaft is pivoted in the shaft seat which is directly or indirectly fixed on the girders.

The said shaft seat can be fitted together with an upper shaft seat and a lower shaft seat, both of which having a half-columnar groove. The rotating shaft on the movable comb plate can be an independently manufactured means which is fixed on the bottom of the second end of the movable comb plate by welding or other fixing method; and can also be a part of the movable comb plate which can be integratedly manufactured. There are at least two shaft seats, which respectively set in the two ends of the rotating shaft of the movable comb plate. For providing better supporting, at the middle of the rotating shaft, there can be set one or more shaft seat corresponding, and the middle portion of the rotating shaft runs through the shaft hole of that shaft seat, and the second end of the movable comb plate has one or more gap at the corresponding place to contain the shaft seat said above.

The said shaft seat can also be an integrated means which has a shaft hole, and set at both two ends of the rotating shaft of the movable comb plate. To manufacture and assemble more conveniently, the rotating shaft on the movable comb plate can be the form as below: a half-columnar rotating shaft is fixed on the bottom of the second end of the movable comb plate by bolts or welding, and the rotating shaft has two half-columnar shaped half-pivot respectively at its two ends, while the second end of movable comb plate correspondingly has another two half-columnar shaped half-pivot respectively at its two side, and among the said four half-pivots, these two same-side half-pivots can be fitted together forming a whole pivot, which is pivoted in the shaft hole of the corresponding shaft seat.

The portion of the rotating shaft on the movable comb plate, which is not supported by the shaft seat, can be supported directly by the concrete made on the scene, and also can be supported by a supporting seat, which has a half-columnar groove. The supporting seat is fixed on a bracket jointed with the girder.

For the concrete girder or the steel girder whose concrete-paved layer is very thick, the bracket can be buried directly in the girder in advance. For the steel girder whose concrete-paved layer is thin, the said bracket has a L-shaped section, and joints with the girder by welding its stand side on the sidewall of the girder. Considering fastness, there can weld a triangle strengthening plate additionally between the bracket and the girder. Additionally, there is resilient cushion between the stand side of the bracket and the edge of the second end of the movable comb plate. The resilient cushion not only can provide a moving space when the movable comb plate rotate comparatively with the supporting seat, but also avoids wear of the stand side of the bracket and the edge of the second end of the movable comb plate.

In order to make the second end of the movable comb plate rotate comparatively with the below supporting seat more easily, there can be filled with lube between the rotating shaft on the movable comb plate and the half-columnar groove of the supporting seat. To avoid dust enter into there, and adapt the distortion of compress caused by the movable comb plate rotate comparatively with the below supporting seat, there can be a resilient cushion between the second end of the movable comb plate and the bracket. Considering fastness and using safety, the movable comb plate and the resilient cushion both can be fixed on the bracket by safe bolts. In case the welding between the rotating shaft and the movable comb plate were broken or separated, that said safe bolt would keep the movable comb plate not leaving from the primary place, and avoiding accident. In order to adapt vertical shift when the movable comb plate rotate comparatively with the below supporting seat, another resilient gasket can be padded around the said safe bolt.

In order to provide a further protection to the comb teeth of the movable comb plate, and avoid the effect of the transverse shift of the girder, every comb teeth set on the first end of the movable comb plate can be pivoted by a shaft within the root teeth on the main body of the movable comb plate.

Compared with the prior art, in this invention, the second end of the movable comb plate is rotatable, by which the movable comb plate will rotate comparatively with the girder when the girder have flexibility distortion causing the ends of the girder to be rising or sinking. Therefore the movable comb plate can keep lying flatly to avoid damage of the expansion joints, and to ensure that the vehicle can pass safely and smoothly.

DETAILED DESCRIPTION OF THE PREFERRED EMBODIMENT

Figure 1:
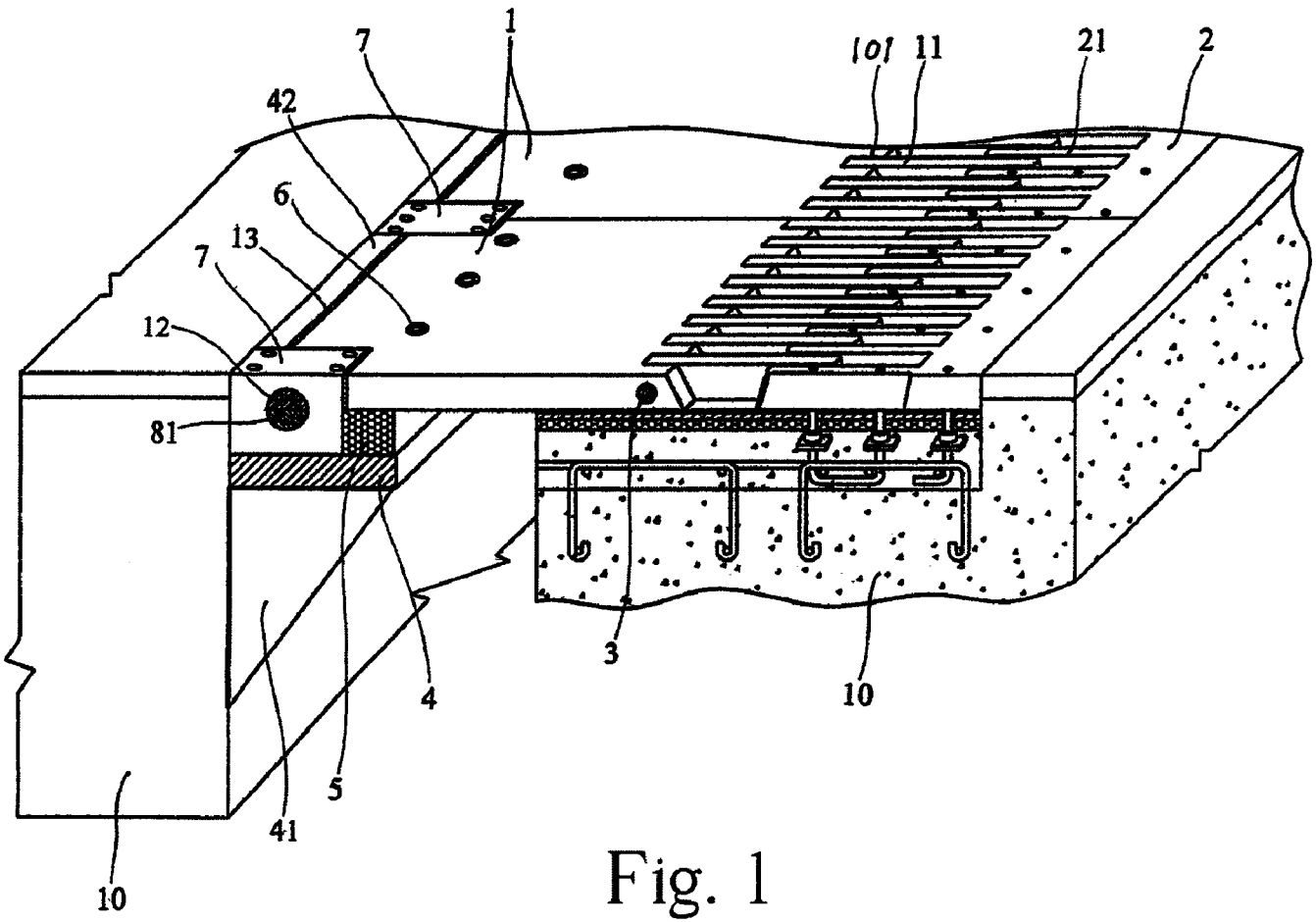
FIG. 1 is a perspective view of the expansion joint of first embodiment of the present invention.
Figure 2:
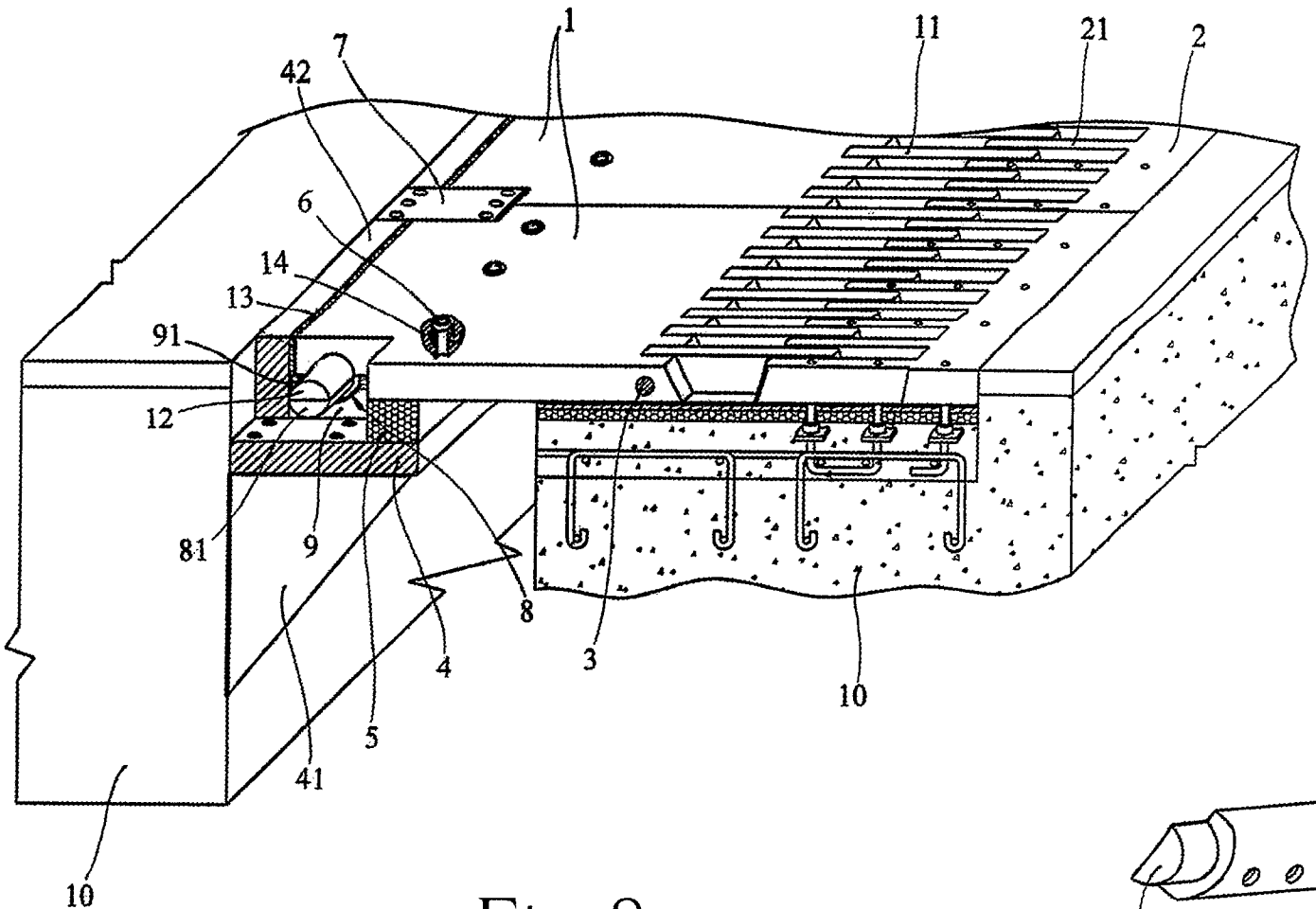
FIG. 2 is a perspective view when the shaft seat in FIG. 1 is taken off.
Figure 3:
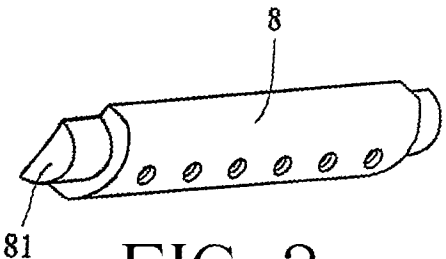
FIG. 3 is a perspective view of the half-columnar rotating shaft in FIG. 2
Figure 4:
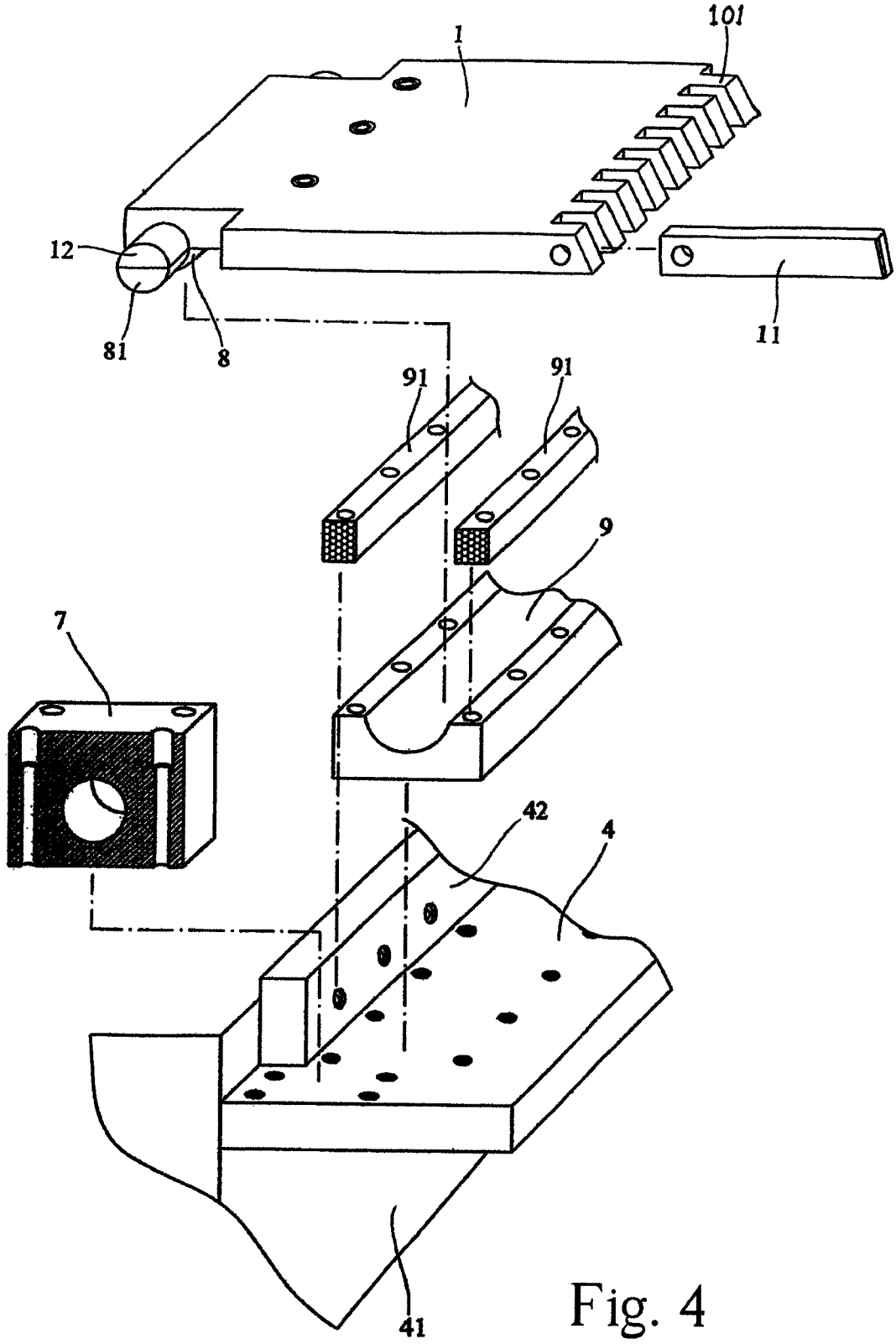
FIG. 4 is a perspective exploded view of partial elements in FIG. 1.

To enable a further understanding of the innovative and technological content of the invention herein, refer to the detailed description of the invention and the accompanying drawings below:

FIGS. 1~4 shows the first embodiment of the present invention applied to steel girder. In this embodiment, the large resisting distortion comb-type bridge expansion joint comprises a fixed comb plate 2 and a movable comb plate 1 which are respectively disposed on the girders 10 located at the two sides of the bridge expansion joint. Every comb tooth 11 is pivoted by a shaft within the root teeth 101 on the first end of the movable comb plate 1, and the comb teeth 11 interdigitate with the comb teeth 21 of the fixed comb plate 2.

Matching the second end of the movable comb plate 1, a bracket which has a L-shaped section joints with the girder 10 by welding its stand side on the sidewall of the girder 10, and a triangle strengthening plate 41 is welded additionally between the bracket and the girder. On the bracket, a supporting seat 9 which has a half-columnar groove on its top surface is fixed by bolts. A shaft seat 7 having shaft hole is fixed at the two sides of the second end of the movable comb plate 1. And there is a resilient cushion 13 between the stand side 42 of the bracket and the edge of the second end of the movable comb plate 1.

A half-columnar rotating shaft 8 is fixed on the bottom of the movable comb plate 1 at its second end by bolts, and is supported by the half-columnar groove of said supporting seat 9, while lube can be filled with between them. And two resilient strips 91 along the rotating shaft 8 are padded between the supporting seat 9 and the movable comb plate 1. Certainly, the rotating shaft 8 can joints directly at the bottom of the second end of the movable comb plate 1.

The said rotating shaft 8 has a half-columnar shaped half-pivot 81 respectively at its two ends. The second end of movable comb plate 1 correspondingly has a half-columnar shaped half-pivot 12 respectively at its two sides. The half-pivot 81, 12 can be fitted together forming a whole pivot, which is pivoted in the shaft hole of the corresponding shaft seat 7.

In this embodiment, between the place nearby the second end of the movable comb plate 1 and the bracket 4, a resilient cushion 5 is padded therein. The movable comb plate 1 and the resilient cushion 5 both are fixed on the bracket 4 by a safe bolt 6, and around the safe bolt 6 there is padded with another resilient gasket 14.

Figure 5:
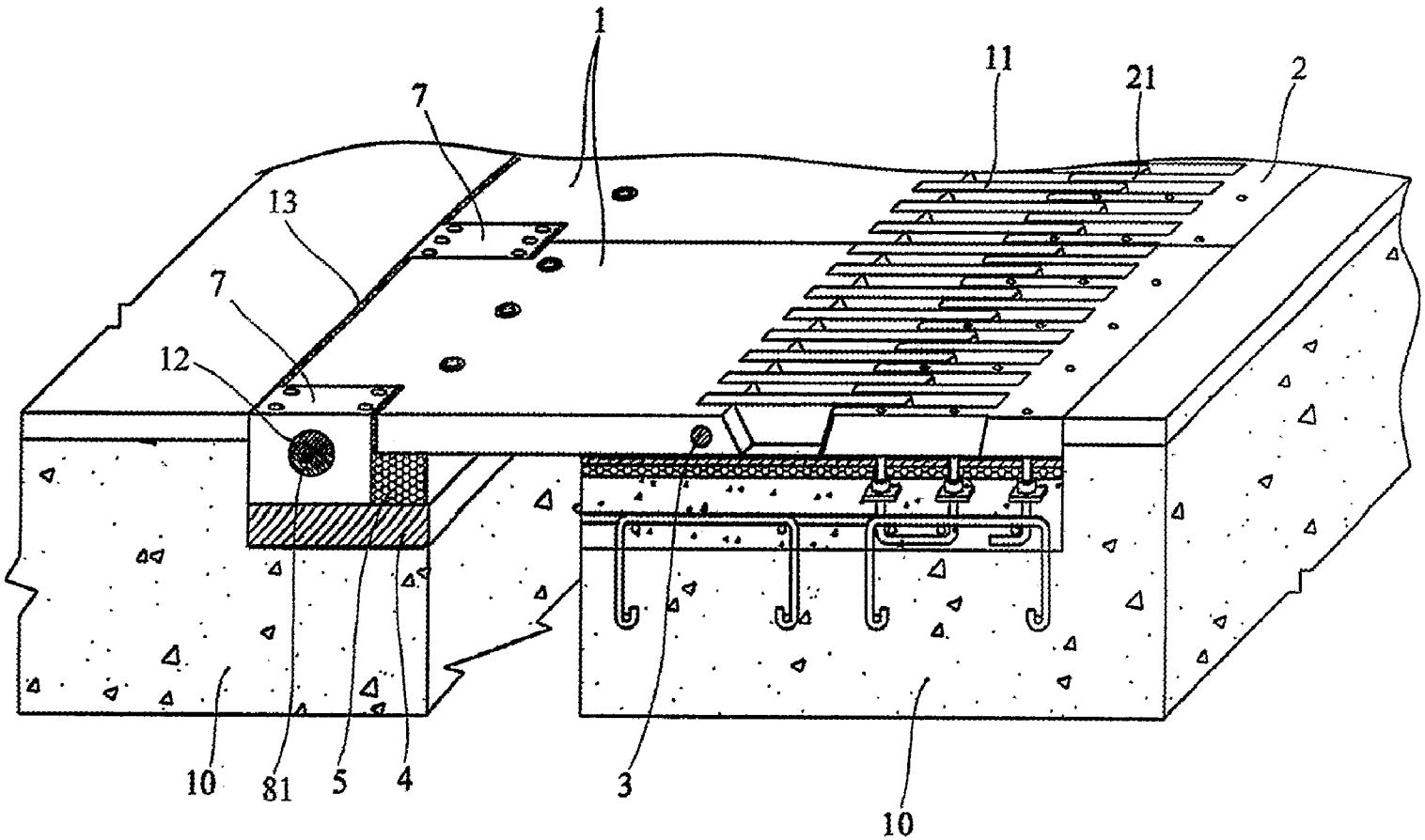
FIG. 5 is a perspective view of the expansion joint of second embodiment of the present invention.

FIG. 5 shows the second embodiment of the present invention applied to concrete girder. The difference of this embodiment compared with the first embodiment is that the bracket 4 is buried directly in the girder 10 in advance. Its structure has been described above, here, will not repeat it again.

Figure 6:
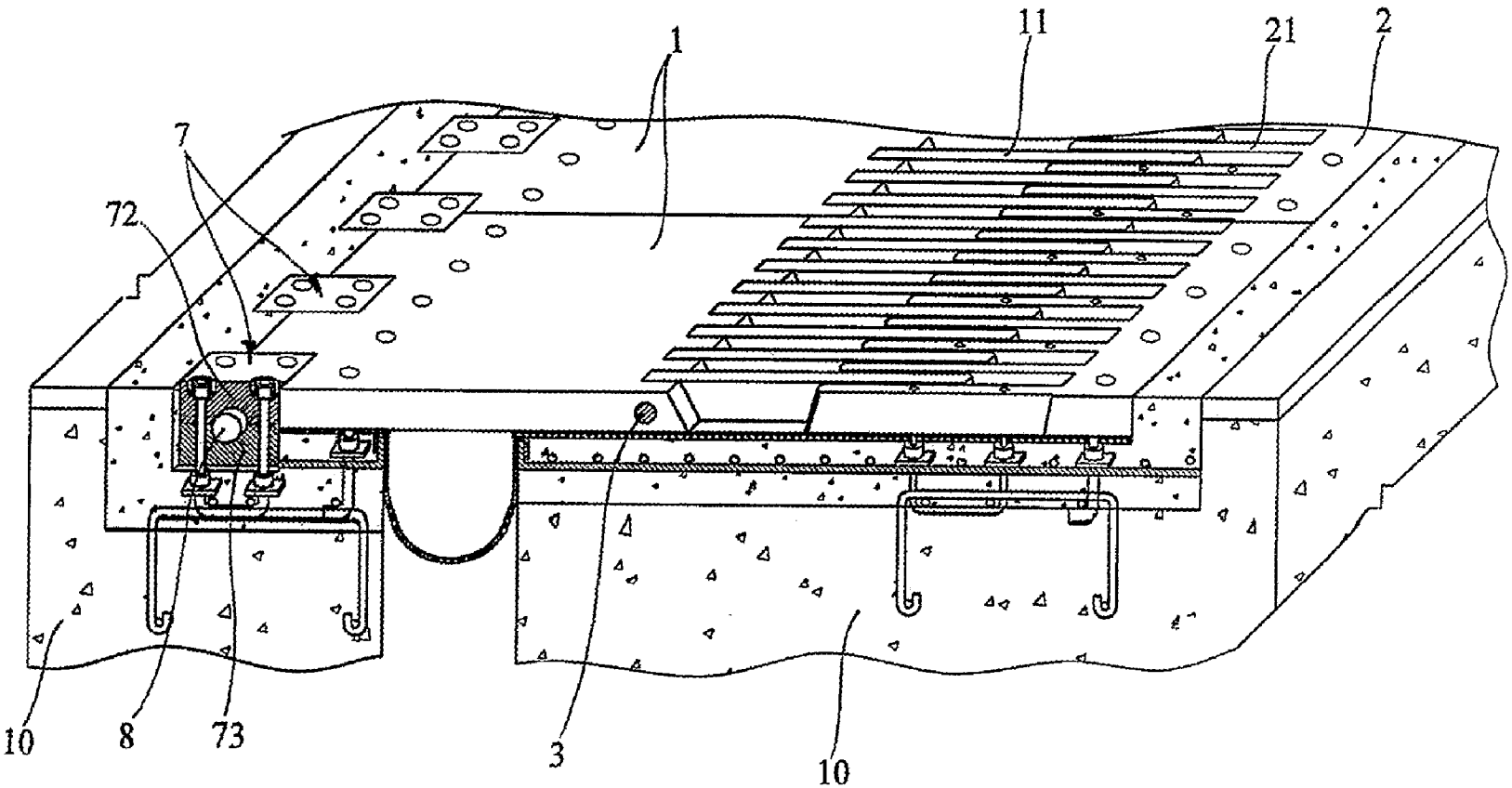
FIG. 6 is a perspective view of the expansion joint of third embodiment of the present invention.
Figure 7:
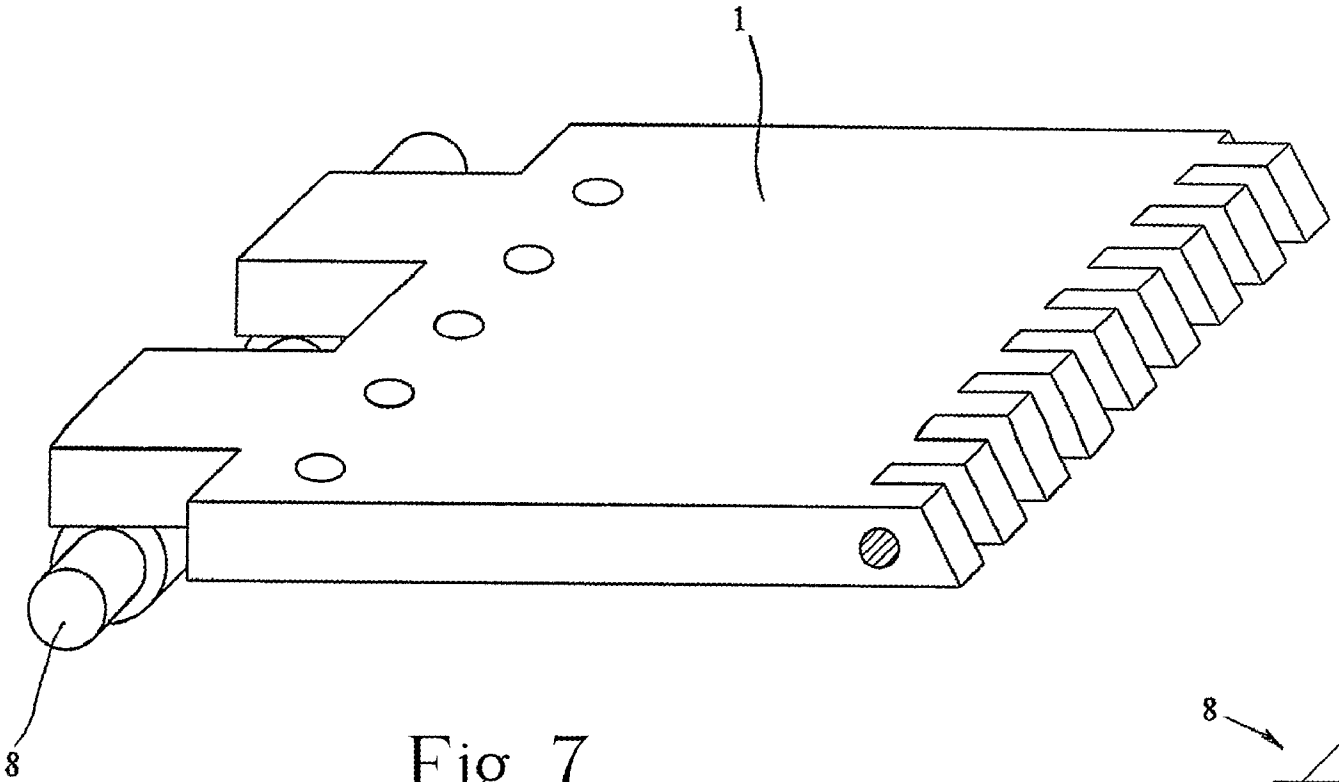
FIG. 7 is a perspective view of the movable comb plate and its rotating shaft in FIG. 6.
Figure 8:
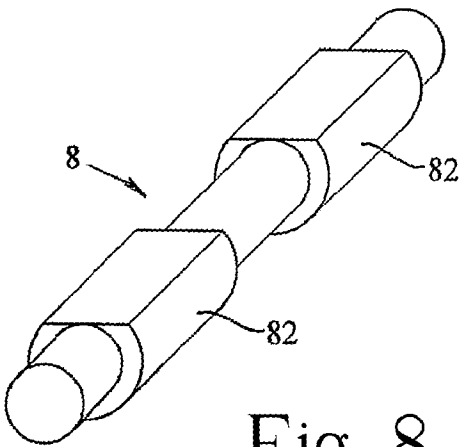
FIG. 8 is a perspective view of the rotating shaft in FIG. 6 and FIG. 7.

FIGS.6~8 show the third embodiment of the present invention. The difference of this embodiment compared with the first embodiment is that: the said rotating shaft 8 on the movable comb plate 1 joints with the movable comb plate 1 by welding, and the pivots on the two ends of the rotating shaft 8 show as an independently whole column, while the shaft seat 7 includes an upper shaft seat 72 and a lower shaft seat 73, both having a half-columnar groove and fixed on the girder 10 by bolts. In this embodiment, there is three such shaft seats 7 corresponding each movable comb plate 1 and its rotating shaft 8; their shaft holes respectively contain and support the two ends and one middle portion of the rotating shaft 8 of the movable comb plate; correspondingly, the second end of movable comb plate 1 has a gap to contain the shaft seat 7. And, in this embodiment, the portion 82 of the rotating shaft 8 on the movable comb plate, which not supported by the shaft seat 7, can be supported directly by the concrete made on the scene. As a result, the supporting seat 9 and the bracket 4 both are not necessary, then the structure is more simple and compacted, and the manufacture and assembling are also convenient.

The invention claimed is:

1. A large resisting distortion comb-type bridge expansion joint, comprising a fixed comb plate, a movable comb plate which are respectively disposed on the girders located at the two sides of the bridge expansion joint; said movable comb plate having a plurality of comb teeth at the first end thereof; and the comb teeth of said movable comb plate interdigitating with comb teeth of said fixed comb plate, wherein said movable comb plate having a rotating shaft on the bottom at the second end thereof, and the two ends of said rotating shaft being pivoted in shaft seats which are directly or indirectly fixed on the girder.

2. The large resisting distortion comb-type bridge expansion joint of claim 1, wherein said shaft seat includes an upper shaft seat and a lower shaft seat, both of which having a half-columnar groove.

3. The large resisting distortion comb-type bridge expansion joint of claim 2, wherein said shaft seat further includes a middle shaft seat, the middle portion of said rotating shaft rotates in the shaft hole of said middle shaft seat, said movable comb plate has a gap at the corresponding place to contain said middle shaft seat.

4. The large resisting distortion comb-type bridge expansion joint of claim 1, wherein said rotating shaft is a half-columnar rotating shaft fixed at the bottom of the second end of said movable comb plate with two half-columnar shaped half-pivot respectively at two ends of the rotating shaft, while the second end of said movable comb plate correspondingly has another two half-columnar shaped half-pivot respectively at two side of the movable comb plate, and among the said four half-pivots, these two same-side half-pivots can be fitted together forming a whole pivot, which is pivoted in the shaft holes of corresponding shaft seat.

5. The large resisting distortion comb-type bridge expansion joint of claim 4, wherein under said rotating shaft, there is a supporting seat having a half-columnar groove for supporting the part of the rotating shaft which is not supported by the shaft seat, said supporting seat is fixed on a bracket jointed with the girder.

6. The large resisting distortion comb-type bridge expansion joint of claim 5, wherein said bracket has a L-shaped section, and joints with the girder by fixing a stand side of the bracket on the sidewall of said girder.

7. The large resisting distortion comb-type bridge expansion joint of claim 6, wherein there is resilient cushion between the stand side of said bracket and the edge of the second end of said movable comb plate.

8. The large resisting distortion comb-type bridge expansion joint of claim 7, wherein there is a resilient cushion between said movable comb plate and said bracket, said movable comb plate and said resilient cushion both are fixed on the bracket or girder by safe bolts.

9. The large resisting distortion comb-type bridge expansion joint of claim 8, wherein there is resilient gasket padded around said safe bolt.

10. The large resisting distortion comb-type bridge expansion joint of claims 1, wherein each one of said comb teeth is pivoted by a shaft within root teeth which is at the first end of said movable comb plate.

11. The large resisting distortion comb-type bridge expansion joint of claims 3, wherein each one of said comb teeth is pivoted by a shaft within root teeth which is at the first end of said movable comb plate.

12. The large resisting distortion comb-type bridge expansion joint of claims 4, wherein each one of said comb teeth is pivoted by a shaft within root teeth which is at the first end of said movable comb plate.

* * * * *